US006491991B2

(12) United States Patent
Seaton

(10) Patent No.: US 6,491,991 B2
(45) Date of Patent: Dec. 10, 2002

(54) ARTIFICIAL TURF SYSTEM

(75) Inventor: Reed J. Seaton, Austin, TX (US)

(73) Assignee: Southwest Recreational Industries, Inc., Leander, TX (US)

( * ) Notice: Subject to any disclaimer, the term of this patent is extended or adjusted under 35 U.S.C. 154(b) by 120 days.

(21) Appl. No.: 09/766,236

(22) Filed: Jan. 18, 2001

(65) Prior Publication Data

US 2001/0033902 A1 Oct. 25, 2001

Related U.S. Application Data

(60) Provisional application No. 60/182,300, filed on Feb. 14, 2000.

(51) Int. Cl.[7] ..... A01N 3/00

(52) U.S. Cl. ..... 428/17; 428/85; 428/92; 428/95; 428/96

(58) Field of Search ..... 428/85, 95, 96, 428/92, 17; 156/61, 72; 139/391, 399; 66/194, 399

(56) References Cited

U.S. PATENT DOCUMENTS

| | | | | |
|---|---|---|---|---|
| 3,315,408 | A | 4/1967 | Fisher | |
| 3,617,413 | A | 11/1971 | Elbert | |
| 3,940,522 | A | 2/1976 | Wessells | |
| 3,987,648 | A | 10/1976 | Fillmore, Jr. et al. | |
| 4,044,179 | A | 8/1977 | Haas, Jr. | |
| 4,319,468 | A | 3/1982 | Kohl | |
| 4,337,283 | A | 6/1982 | Haas, Jr. | |
| 4,358,939 | A | 11/1982 | Kohl | |
| 4,389,435 | A | 6/1983 | Haas, Jr. | |
| 4,444,815 | A | 4/1984 | Friedrich | 3/1 |
| 4,665,717 | A | 5/1987 | Atsushi | 35/6 |
| 4,739,603 | A | 4/1988 | Butler | |
| 5,065,601 | A | 11/1991 | Kaufmann | |
| 5,205,068 | A | 4/1993 | Solomou | |
| 5,462,778 | A | 10/1995 | Ishikawa | |
| 5,489,317 | A | 2/1996 | Bergevin | |
| 5,586,408 | A | 12/1996 | Bergevin | |
| 5,601,886 | A | 2/1997 | Ishikawa et al. | |
| 5,850,708 | A | 12/1998 | Bergevin | |
| 5,901,583 | A | 5/1999 | Kemper et al. | 27/24 |
| 6,029,397 | A | 2/2000 | Motz et al. | |
| 6,094,860 | A | 8/2000 | Motz et al. | |
| 6,145,248 | A | 11/2000 | Bergevin | 13/8 |
| 6,173,528 | B1 | 1/2001 | Motz et al. | |
| 6,216,389 | B1 | 4/2001 | Motz et al. | |
| 6,242,062 | B1 | 6/2001 | de Vries | 13/8 |
| 2001/0033902 | A1 * | 10/2001 | Seaton | 428/15 |

FOREIGN PATENT DOCUMENTS

| | | |
|---|---|---|
| DE | 2248911 | 4/1974 |
| DE | 3703866 | 8/1988 |
| EP | 0174755 A1 | 8/1984 |

(List continued on next page.)

*Primary Examiner*—Deborah Jones
*Assistant Examiner*—Abraham Bahta
(74) *Attorney, Agent, or Firm*—Akin Gump Strauss Hauer & Feld LLP

(57) ABSTRACT

An artificial turf that includes a first face yarn, a second face yarn, and a stitch-in yarn. The second face yarn is textured in some embodiments, for at least the reason of creating a zone such as a textured zone. A knot is formed by knitting the first face yarn, the second face yarn, and the stitch-in yarn together. A row of knots is also formed in this manner. A backing is formed when a lay-in yarn is extended between at least two rows of the knots and knitted to hold the at least two rows of knots together. A coating is coupled to the backing to prevent, among other things, detachment of the yarns after extended use of the artificial turf. An underlayment is positioned beneath the backing such that a stable base is provided for the artificial turf.

24 Claims, 3 Drawing Sheets

FOREIGN PATENT DOCUMENTS

| | | | |
|---|---|---|---|
| EP | 0154841 | 2/1985 | |
| EP | 0373282 | 12/1988 | |
| EP | 0403008 A1 | 8/1990 | |
| EP | 0724825 A1 | 8/1996 | |
| FR | 2096340 | 2/1972 | |
| GB | 1320868 | 6/1973 | |
| GB | 2329975 | 1/1974 | |
| JP | 59-151813 | 8/1984 | |
| JP | 4-24432 | 2/1992 | |
| NL | 1004656 | 11/1996 | ..... 13/8 |
| WO | WO 92/05316 | 4/1992 | ..... 17/20 |
| WO | WO 94/00639 | 1/1994 | |
| WO | WO 98/23817 | 6/1998 | ..... 13/8 |
| WO | WO 99/28557 | 6/1999 | ..... 13/8 |

* cited by examiner

ARTIFICIAL TURF SYSTEM

CROSS-REFERENCES TO RELATED APPLICATIONS

This application claims the benefit of U.S. Provisional application Ser. No. 60/182,300, filed Feb. 14, 2000, which is incorporated herein by reference in its entirety.

BACKGROUND

1. Field of the Invention

The present invention pertains to artificial turf, and more particularly to a knitted artificial turf system.

2. Description of the Related Art

Various artificial turf systems have been developed that provide a synthetic turf playing surface for various sports and recreational activities. One example of an artificial turf involves a system wherein fibers are tufted into a primary backing. Various combinations of yarns/fibers are used in the tufted embodiments.

One playing surface is known that includes a subsurface, a pile fabric resembling grass and a compacted top-dressing comprising a mixture of from 25 to 95 volume percent resilient particles and from 5 to 75 volume percent fine sand. The playing surface includes a multi-filament yarn tufted into a woven fabric backing to form a pile fabric with pile elements that resemble grass. A suitable subsurface may consist of concrete or asphalt pavement, compacted clay, or gravel rolled into ordinary dirt.

At least due to tufting, prior art turf systems, among other things, tend to be of a loose construction and may be undesirable for certain applications. Many other problems and disadvantages of the prior art will become apparent to one skilled in the art after comparing such prior art with the present invention as described herein.

SUMMARY OF THE INVENTION

An artificial turf is provided that is not tufted. The artificial turf has two face yams, one of which is non-textured, and one of which is textured. The artificial turf is preferably knitted, and the non-textured face yarn or pile has a pile height exceeding about 0.6 inch, preferably having a height of at least about 1.0 inch. In use, the textured pile has a height significantly lower than the pile height of the non-textured pile, preferably a pile height of at least 25% less than the pile height of the non-textured pile. The textured and non-textured pile yarns are knotted together with a stitch-in yarn to form rows of knots in the machine direction of the artificial turf thus made, and lay-in yarns are interlocked with the rows of knots to form a base for the pile yarns. A seal is preferably applied to the backing for additional dimensional stability.

Turf that is constructed according to principles of the present invention has been known to use a knitting machine that may contain over 1,000 needles to produce a width of artificial turf of about 15 feet. The assembly process is more complex than tufting. The pile yarn and stitch-in yarn are inserted into a knitting needle. Lay-in yarn is interlocked with the pile and stitch-in yarn through a separate feed mechanism for the machine. Loops of pile fabric are formed and cut by a slitter. The knitted turf is subjected to a finishing operation in which a suitable seal material is applied to penetrate the contact points in the backing and to stabilize the structure. This process is usually accompanied by a heat treatment that stabilizes the fabric and conditions the pile.

Turf according to principles of the present invention is made using a knitting process. The artificial turf thus formed is preferably mounted on a subsurface, and preferably the subsurface includes concrete or asphalt pavement, compacted clay, gravel, gravel mixed with soil, and then more soil or a foamed product is laid on the subsurface. A fill material such as sand and/or rubber particles is preferably filled in and around the textured and non-textured pile to about the height of the textured pile.

Various aspects of the present invention may be realized through an artificial turf that includes a first face yarn, a second face yarn, a lay-in yarn, and a stitch-in yarn. The second face yarn is textured, for at least the reason of creating a textured zone. A knot is formed by knitting the first face yarn, the second face yarn, the lay-in yarn, and the stitch-in yarn together. A row of knots is also formed in this manner. A backing is formed when the lay-in yarn is extended between at least two rows of the knots and knitted to hold the at least two rows of knots together. A fill material is also placed on top of the backing.

Numerous variations exist with respect to the type of material that is used to create the first face yarn, the second face yarn, the stitch-in yarn, and the lay-in yarn. Of particular interest are the different types of physical shapes and feel that may be given to the first face yarn depending upon factors such as the spinneret that is used to produce the first face yarn and the pellet that is produced for the extrusion with the spinneret.

Various aspects of the present invention may also be found in a method for creating an artificial turf. The method includes, not necessarily in this order, the following steps: extruding a pellet through a spinneret to form an extended ribbon; knitting the extended ribbon into a blend of other ribbon, that has been textured, and stitch-in yarn to form knots; cutting the extended ribbon to create a flat face yarn that has a length of approximately one inch; forming rows of knots from the extended ribbon, the other ribbon, and the stitch-in yarn; and knitting a lay-in yarn into the rows of knots to combine the rows of knots and create a backing for the artificial turf while the combination also creates a textured zone on top of the backing and the flat face yarn extends upwardly from the textured zone.

Other aspects of the present invention will become apparent with further reference to the drawings and specification which follow.

BRIEF DESCRIPTION OF THE DRAWINGS

A better understanding of the present invention can be obtained when the following detailed description of the drawings is considered in conjunction with the following drawings.

DETAILED DESCRIPTION OF THE DRAWINGS

Figure 1:
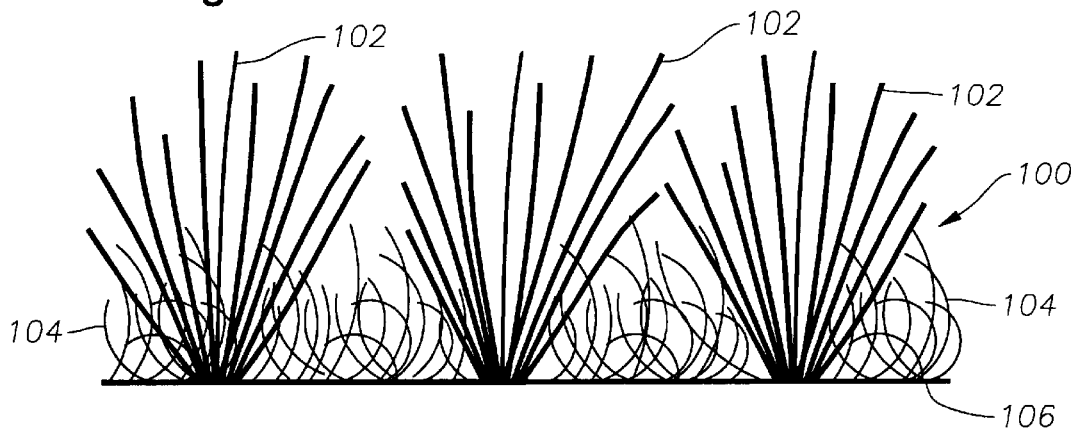
FIG. 1 is a cross-sectional view of an exemplary artificial turf that is constructed in accordance with principles of the present invention.

FIG. 1 is a cross-sectional view of an exemplary artificial turf 100 that is constructed in accordance with principles of the present invention. The artificial turf 100 has been constructed having a flat face yarn 102 and a textured face yarn 104 that are knitted into a backing 106. The backing 106 is described in greater detail with respect to FIG. 4, but for purposes of a general and exemplary description of the artificial turf 100, it should be noted that the backing 106 is a combination of fibers that are used to knit the flat face yarn 102 and the textured face yarn 104 into a single piece of material that is used as the artificial turf 100. Although the textured face yarn 104 is described herein as being textured, it is not required to be textured but is referred to herein as "textured" to distinguish itself from the flat face yarn 102.

When the knitting of the artificial turf 100 is completed, the flat face yarn 102 and the textured face yarn 104 extend upwardly from the backing 106. The backing 106 is sometimes referred to using other similar nomenclature such as "base," but for purposes of the present disclosure it will be referred to as the backing 106. After the flat face yarn 102 and the textured face yarn 104 are knitted into the backing 106, the backing 106 may have a coating/seal (not pictured) placed on it that gives the artificial turf 100 greater stability and strength. The coating may comprise at least one of acrylic, polyurethane, latex, etc., or some combination thereof to assist in preventing the flat face yarn 102 and the textured face yarn 104 from undesirably detaching from the artificial turf 100 with extended use.

A desirable aspect of the embodiment disclosed in FIG. 1 is that the artificial turf 100 is knitted rather than tufted. Although knitting the artificial turf 100 adds a degree of complexity to the mass production of the artificial turf 100, the inventor of the disclosed embodiment has determined that the value of the knitted artificial turf 100 outweighs the drawbacks of the added complexity that is required for construction of the artificial turf 100. Another desirable aspect of the disclosed embodiment is the use of two separate yarns, the flat face yarn 102 and the textured face yarn 104. The two yarns 102 and 104 are knitted in a manner that allows other beneficial features to ultimately be realized in the artificial turf 100. Two needles are used in the knitting, but variations of the number of needles is contemplated, e.g., one or more needles could be used.

The textured face yarn 104 is often referred to as a textured zone and is typically shorter than the flat face yarn (i.e., the non-textured yarn) 102, thereby providing a preferred area in which sand or rubber fill is placed to alter the overall texture of the artificial turf 100 for a particular use of the artificial turf 100. The textured face yarn 104, in one embodiment, is a multi-filament yarn having between 2 and 20 ends, preferably between 6 and 12 ends.

In one embodiment the textured face yarn 104 is made by passing a filament through a steam jet, preferably upwards through the steam jet. The ejected fiber is packed in a column such that the fiber is curled, crumpled and wrinkled. The fiber is packed in a column, and air is drawn through the column in a transverse direction to cool the filament, and a molecular memory of the crumpled, curled and wrinkled state is imparted into the textured face yarn 104. Still other features of the textured face yarn 104 and the artificial turf 100 are described in relation to the description of the other figures herein.

Figure 2:
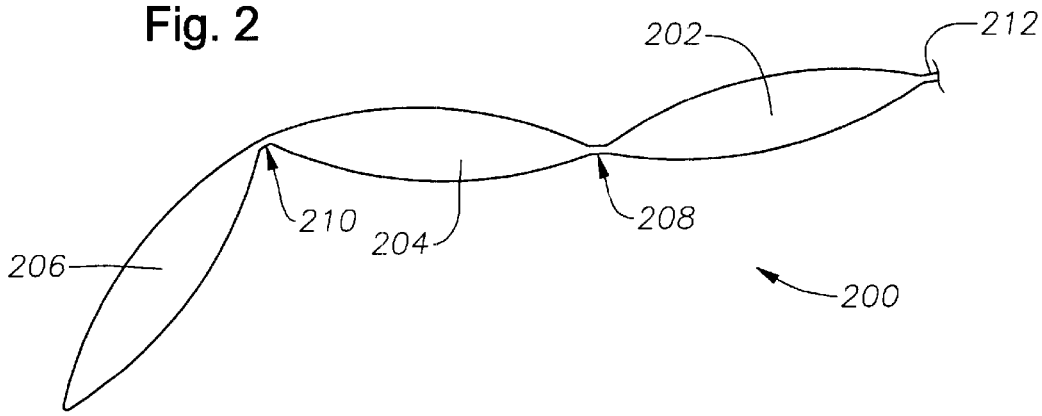
FIG. 2 is a cross-sectional view of an exemplary ribbon that is used in the artificial turf of FIG. 1.

FIG. 2 is a cross-sectional view of an exemplary ribbon 200 that is used to create the flat face yarn 102 that makes up the artificial turf 100. As illustrated, the ribbon 200 includes three oval portions 202, 204, and 206. These oval portions 202, 204, and 206 are each connected by a thin segment 208 and 210. The thin segment 208 connects the oval portion 202 and the oval portion 204 while the thin segment 210 connects the oval portion 204 and the oval portion 206. A thin segment 212 is illustrated to demonstrate the potential of connecting additional oval portions (not pictured) with the illustrated three oval portions 202, 204, and 206.

Of note, the ribbon 200 is not textured. Thus the designation of "flat" when the ribbon is used to produce the flat face yarn 102. The flat face yarn 102 is sometimes referred to as pile, pile yarn, filament, or other similar designation, but for purposes of the present disclosure is referred to herein as the flat face yarn 102. The flat face yarn 102 is constructed from the ribbon 200 that is created from a pellet that is extruded through a spinneret.

Figure 3:
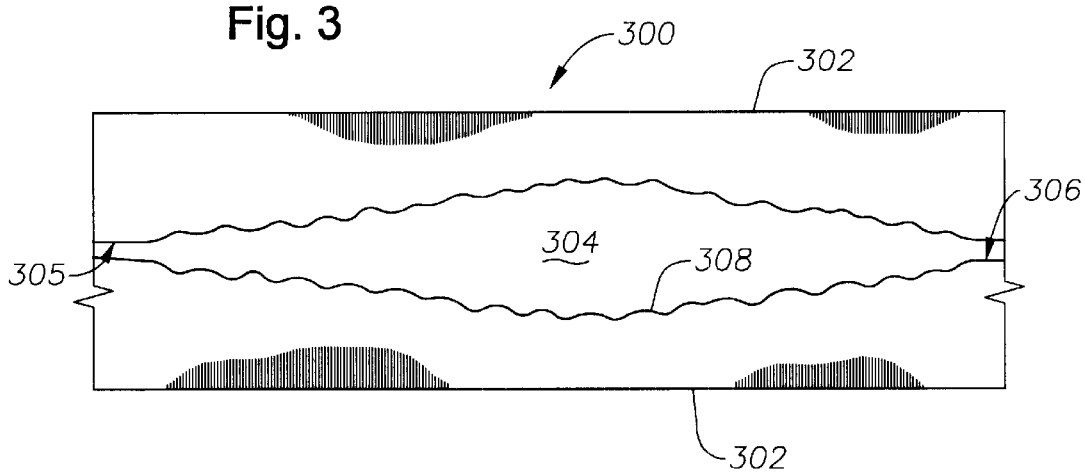
FIG. 3 is a plan view of a portion of an exemplary spinneret that is used to produce the ribbon of FIG. 2 that is used to produce the artificial turf of FIG. 1.

FIG. 3 is a plan view of a portion of an exemplary spinneret 300 that is used to produce the ribbon 200. As stated earlier, the ribbon 200 is cut to create the flat face yarn 102 that is used to produce the artificial turf 100. The illustrated portion of the spinneret 300 is one third of the spinneret that was used to produce the ribbon 200. The spinneret that produced the ribbon 200 has three openings where the pellet is passed that allow the ribbon 200 to be one continuous fiber with the three oval portions 202, 204, and 206. Of course, to produce the three oval portions 202, 204, and 206, three portions of the illustrated portion of the spinneret 300 must be utilized.

The illustrated portion of the spinneret 300 includes a housing 302 that forms an opening 304 for the pellet to pass. The illustrated opening 302 has a serrated surface 308 but could have other types of surfaces as discussed herein with relation to other FIGS. of the specification. Regardless of the spinneret that is utilized, the ribbon 200 is not textured and is ultimately used to create the flat face yarn 102. When the portion of the spinneret 300 is duplicated twice, small openings 305 and 306 are used to couple the duplicated portions of the spinneret 300 together and form three openings 304 that share the small openings 305 and 306. In this manner, the ribbon 200 is produced as one continuous fiber having the three oval portions 202, 204, and 206.

The pellet (not pictured) is preferably a polymeric or polyolefin material. For example, the pellet may be polyethylene, polypropylene, polytrimethyleneterethalate, various copolymers, etc. The pellet could also be of a nylon material such as nylon 6.6. The pellet may be constructed with varying chemicals to produce different textures, colors, physical properties, etc. When the pellet is extruded through hole 304 and similar holes connected by small openings 305 and 306, the ribbon 200 is formed and is sometimes referred to as a segmented serrated oval (SSO) type of ribbon. Small openings 305 and 306 in the spinneret yield the ribbon 200 that is correspondingly thin at those points, which adapts the ribbon for rupture, breakage, or splitting to provide multiple tips from a single ribbon 200.

Figure 4:
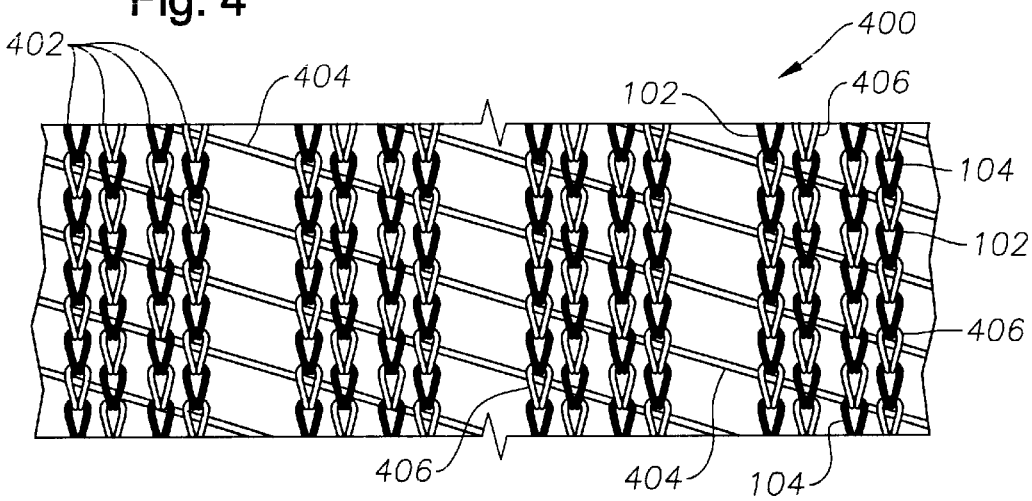
FIG. 4 is a diagram of an exemplary backing for the artificial turf of FIG. 1.

The single continuous ribbon 200 that is produced when a pellet is extruded through a three opening spinneret is knitted with the other yarns of the artificial turf 100 to create the backing 106 (as discussed in greater detail with relation to FIG. 4). The ribbon 200 is referred to as the flat face yarn 102 when it is cut. The ribbon 200 is cut according to the desired grass dimensions of the artificial turf 100. For example, the flat face yarn 102 is typically cut to appear longer than the textured face yarn 104.

As stated, the thin segments 208 and 210 of the ribbon 200 preferably rupture when the flat face yarn 104 is stressed, e.g., when a game is played on the artificial turf 100. When rupturing occurs, the oval portions 202, 204, and 206 become individual filaments. In this manner, although the ribbon 200 is knitted into the artificial turf 100 as a single filament, it can become a multi-filament yarn during use, i.e., the thin segments 208 and 210 break, rupture or split.

More generally, as eluded to by thin segment 212, a ribbon may contain other than three oval portions that are connected side by side by thin segments. For example, the oval portions may range in number between two and twelve, preferably between two and six. The oval portions provide rigidity so that the flat face yarn 102 stands up nearly vertically after installation on a subsurface, but before a fill material is added (as described with relation to FIG. 5).

FIG. 4 is a diagram of an exemplary backing 400 (such as the backing 106) for the artificial turf 100. The backing 400 includes rows of knots 402 that are created from the different yarns that are knitted to form the artificial turf 100. For example, a lay-in yarn 404 is provided as a building block for the backing 400. The flat face yarn 102 and the textured face yarn 104 are knotted with a stitch-in yarn 406 to form the rows of knots 402. The stitch-in yarn 406 is depicted as white loops, and the flat face yarn 102 and textured face yarn 104 (pile yarns) are depicted as dark loops. Similar to the flat face yarn 102 and the textured face yarn 104, the lay-in yarn 404 and the stitch-in yarn 406 are constructed from various different materials and dyes according to the intended use of the artificial turf 100, e.g., polyester, nylon, and polyolefin may be selected. As will be understood by those of ordinary skill in the art upon viewing the present disclosure, the above mentioned fibers are knitted to form the backing 400.

Figure 5:
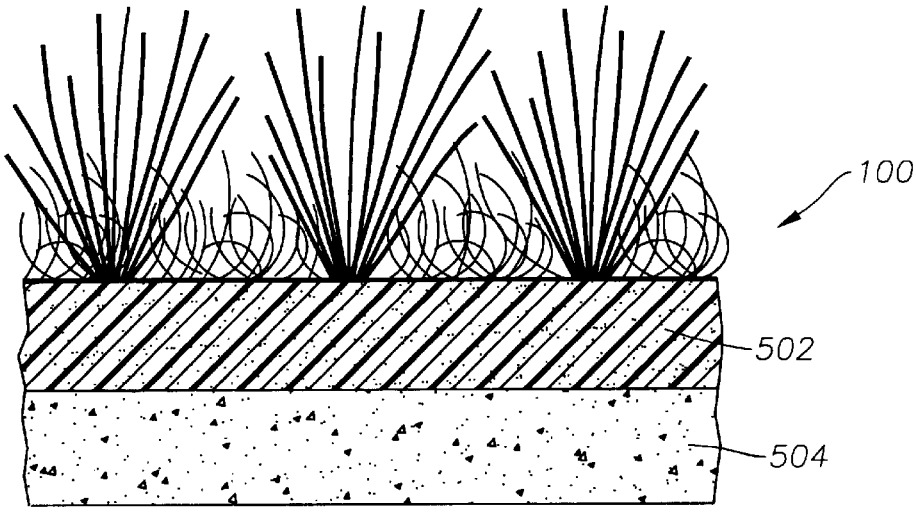
FIG. 5 is a cross-sectional view of the exemplary artificial turf of FIG. 1 wherein a foam pad and a subsurface are further illustrated.

FIG. 5 is a cross-sectional view of the exemplary artificial turf 100 wherein a foam pad 502 and a subsurface 504 are further illustrated. In the illustrated embodiment, the foam pad 502 is mounted on the subsurface 504 using standard coupling procedures familiar to those of ordinary skill in the art. The subsurface 504 may consist of gravel, soil, a mixture of gravel and soil, asphalt, concrete or other suitable materials that provide a stable base. The foam pad 502 and the subsurface 504 are typically selected according to the intended use of the artificial turf 100 and are sometimes referred to, either singly or as a whole, as an underlayment. The underlayment may include any number of different materials, but is commonly selected from the group consisting of asphalt, gravel and foam padding. Although not illustrated, a fill material may be added on top of the backing in a depth of approximately the depth of the textured face yarn 104 or zone. The fill material is commonly sand and/or rubber particles but could be any suitable material for the event that is to be performed on the artificial turf 100. In any event, the material should have resiliency and provide shoe traction with reduced friction to avoid injury when a player falls or slides thereon.

Figure 6:
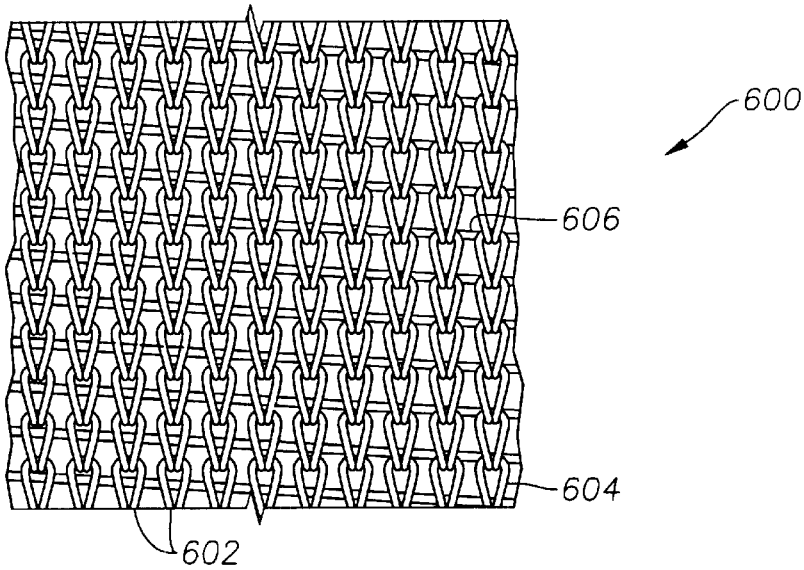
FIG. 6 depicts an exemplary knitted backing of an artificial turf constructed according to principles of the present invention.

FIG. 6 depicts an exemplary knitted backing 600 of an artificial turf constructed according to principles of the present invention. The artificial turf is knitted and includes the two types of yarn that are described in greater detail in relation to FIG. 1, i.e., a flat face yarn and a textured face yarn. The backing 600 of the artificial turf includes rows of knots 602 that form a portion of the backing 600. Each knot is formed by stitching together a stitch-in yarn 604 and at least one of the flat face yarn and the textured face yarn. A lay-in yarn 606 is interlocked with adjacent rows of knots 602 to provide dimensional stability. Thus, four yarns are knitted together to form the backing 600 of the artificial turf: the flat face yarn (commonly nylon), the textured face yarn (commonly polyethelene), the stitch-in yarn (commonly polyester) 604; and the lay-in yarn (commonly polyester) 606. Of course, the stitch-in yarn 604 and the lay-in yarn 606 may each be constructed of the same or different materials as will be understood by those of ordinary skill in the art upon viewing the present disclosure.

Figure 7A:
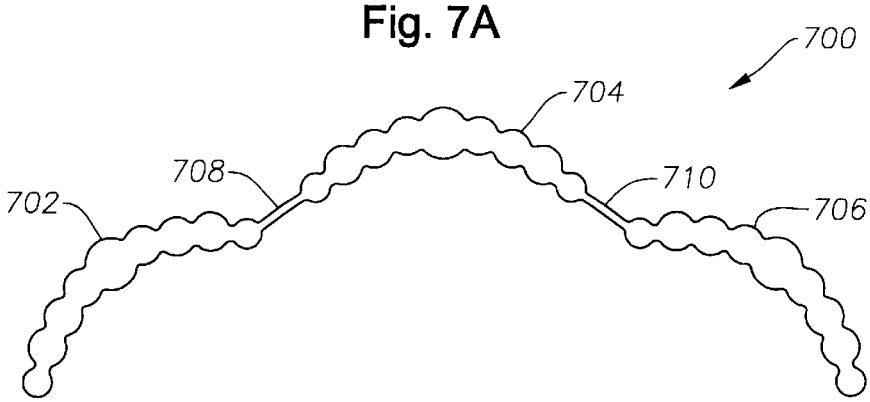
FIG. 7A is a plan view of an exemplary spinneret that may be used in the production of the artificial turf of FIG. 1.

FIG. 7A is a plan view of an exemplary spinneret 700 that may be used in the production of the artificial turf 100. The spinneret 700 in divided into three portions 702, 704, and 706, each of which is serrated. The portions 702 and 704 are connected by an extension 708 while the portions 704 and 706 are connected by an extension 710. The illustration of the spinneret 700 depicts the openings through which a pellet is extruded. The ribbon that is produced by the extrusion of the pellet through such a spinneret as the spinneret 700 has essentially the same cross sectional characteristics as the spinneret 700. The extensions 708 and 710 provide the ribbon with thin portions that are intended to break when the artificial turf that is constructed from the ribbon that is produced with the spinneret 700 is used. The flat face yarn that is produced varies in texture according to the type of spinneret that is selected for the extrusion, but would still be considered to be a "non-textured" yarn. The spinneret 700 produces a ribbon that is sometimes referred to as "bat wing."

Figure 7B:
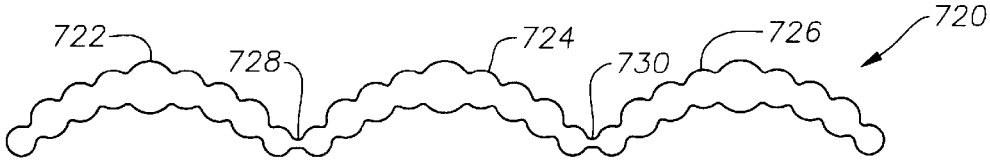
FIG. 7B is a plan view of an exemplary variation in the dimensions of the spinneret of FIG. 7A.

FIG. 7B is a plan view of an exemplary variation in the dimensions of the spinneret 700. A spinneret 720 is illustrated wherein three openings 722, 724, and 726 are included. The openings 722, 724, and 726 are essentially the same and are positioned side by side being connected with extensions 728 and 730. In this embodiment, the openings 722 and 724 are connected by the extension 728. The extension 728 is much smaller than the extension 708 and provides a reduced, when compared to extension 708, amount of ribbon that is left on the opening edges of openings 722 and 724 when the extension 728 breaks. In a like manner, openings 724 and 726 are connected by the extension 730. The dimensions of the spinneret 720 provide another variation for the texture of the artificial turf.

Figure 7C:
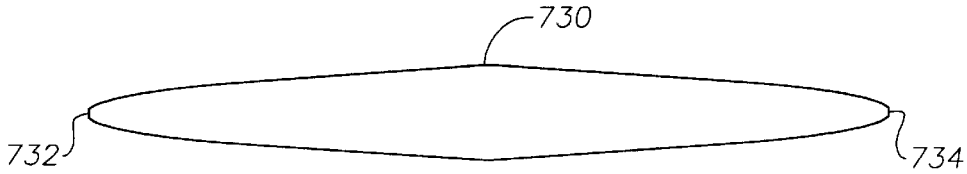
FIG. 7C is a plan view of an exemplary spinneret that is another variation of the spinneret of FIG. 3 and that may be used in the production of the artificial turf of FIG. 1.

FIG. 7C is a plan view of an exemplary spinneret 730 that is a variation of the spinneret that is constructed from the portion of the spinneret 300 and that may be used in the production of the artificial turf 100. The spinneret 730 is sometimes referred to as a non-segmented diamond and resembles an elongated diamond without sharp corners. The ends 732 and 734 are modified to be open to allow the spinneret 730 to connect to another spinneret such as another spinneret 730. In addition, the spinneret 730 may be combined with other types of spinnerets such as with the spinnerets 720 or 700 or portions thereof. Numerous variations of the differing types of spinnerets are contemplated and will become apparent to those skilled in the art upon viewing the present disclosure.

Figure 7D:
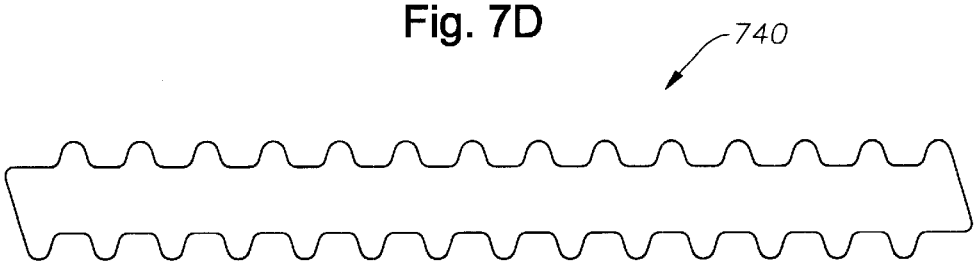
FIG. 7D is a plan view of an exemplary spinneret that is still another variation of the spinneret of FIG. 3 and that may be used in the production of the artificial turf of FIG. 1.

FIG. 7D is a plan view of an exemplary spinneret 740 that is still another variation of the portion of the spinneret 300 and that may be used in the production of the artificial turf

100. The spinneret 740 is often referred to as a ribbed rectangle and produces an artificial turf with a slighter greater coarseness that the spinneret 730. However, depending on the spinneret combination that is desired, the flat face yarn is produced having either a soft or stiff feel in the artificial turf. For example, when spinnerets are combined with little or no angle between them, the artificial turf tends to be stiffer than when the spinnerets are combined with significant angling therebetween; when spinnerets having substantial serrations are used to produce the ribbon for the flat face yarn, the artificial turf is not a preferred sliding surface. Other combinations of the spinnerets are contemplated and should be selected according to the intended use of the artificial turf.

EXAMPLE

A knitted nylon artificial turf is made using a segmented serrated oval as a ribbon type for a flat face yarn. The flat face yarn has 650 denier with 9 ends. A textured face yarn is formed of a nylon material and has a cross-section of a diamond shape. The weight of the textured face yarn is 420 denier with 6 ends.

The flat face yarn (segmented serrated oval), the textured face yarn and a stitch-in yarn of a polyester material are knitted together, which forms a knot, and thus rows of knots. A lay-in yarn of polyester material is used to interlock the rows of knots together. An acrylic material is placed on the rows of knots at the contact points in order to add dimensional stability. The acrylic material has been cured at 350° F. at 3 feet/minute through an oven.

The data in Table 1 reflects data that has been collected from two prototype samples. The expected ranges for the differing samples varies, e.g., the total weight is expected to range from 45–80 ounce/square yard, polyester weight ranges from 7.0–9.0 ounce/square yard, total yarn (pile) weight ranges from 42.0–77.0 ounce/square yard, yarn (pile) height of the non-textured or flat face yarn ranges from 0.6–1.5 inches, knots (wales) per inch ranges from 6.0–6.5, stitches per inch ranges from 6.0–9., and acrylic ranges from 3.0–4.0 ounces/square yard. Table 1 reflects the actual value of the two samples.

TABLE 1

| | Sample 1 | Sample 2 |
|---|---|---|
| Total Weight, oz./yd$^2$ (of the fabric) | 57.7 | 49.1 |
| Polyester Weight, oz./yd$^2$ (just polyester) | 8.2 | 7.7 (Estimated) |
| Total Pile Weight, oz./yd$^2$ (tex and non-tex) | 49.5 | 37.4 (Estimated) |
| Pile Height, inches (non-tex face yarn) | 1.55 | 1.4 |
| Wales per inch (knots/in.) | 6.5 | 6.5 |
| Stitches per inch | 7.2 | 6.5 |
| Acrylic, oz./yd$^2$ | 3.1 (Estimated) | 4.0 (Estimated) |

The above-listed sections and included information are not exhaustive and are only exemplary for the artificial turf of the present invention. The particular sections and included information in a particular embodiment may depend upon the particular implementation and the included devices and resources. Although a system and method according to the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

What is claimed is:

1. An artificial turf comprising:

a first face yarn and a second face yarn, the second face yarn being textured;

a backing that is formed by knitting the first face yarn, the second face yarn, a stitch-in yarn, and a lay-in yarn such that the first face yarn appears to be longer than the second face yarn;

a coating coupled to the backing to prevent, among other things, detachment of the yarns after extended use of the artificial turf; and an underlayment positioned beneath the backing such that a stable base is provided for the artificial turf.

2. The artificial turf of claim 1 wherein the first face yarn extends at least one inch above the backing.

3. The artificial turf of claim 1 wherein the first face yarn is selected from the group consisting of nylon 6.6, nylon 6, polypropylene, polyethylene, polyolefin co-polymers, extruded rubber, and blends of these materials.

4. The artificial turf of claim 1 wherein the first face yarn is a ribbon comprising at least two elements joined by a thin segment.

5. The artificial turf of claim 4 wherein the thin segment is adapted to rupture during use of the artificial turf to yield at least two individual filaments for each first face yarn.

6. The artificial turf of claim 1 wherein the first face yarn has a cross-section resembling three ovals laid end to end to provide a center oval and two outer ovals, and wherein the center oval is joined to each of the outer ovals by a thin segment that is adapted to rupture during use to yield three individual filaments per first face yarn.

7. The artificial turf of claim 6 wherein each of the ovals has an outer surface, each outer surface being serrated.

8. The artificial turf of claim 1 wherein the texture in the second face yarn comprises curling, crumpling, and wrinkling of the yarn upon itself so that the second face yarn does not extend to its full potential height.

9. The artificial turf of claim 8 wherein the second face yarn has a molecular memory of its curled, crumpled and wrinkled state.

10. The artificial turf of claim 1 wherein the backing further comprises stitch-in yarns that are knitted with the first and the second face yarns to form rows of knots.

11. The artificial turf of claim 10 wherein the backing further comprises a lay-in yarn that is used to knit the rows of knots together to form the backing.

12. The artificial turf of claim 11 wherein the backing further comprises a coating, the coating having holes formed therein for promoting drainage.

13. The artificial turf of claim 1 further comprising a fill material disposed on top of the backing.

14. The artificial turf of claim 13 wherein the fill material is approximately the depth of the second face yarn.

15. An artificial turf comprising:

a first face yarn, a second face yarn, and a stitch-in yarn, the second face yarn being textured;

a knot that is formed by knitting the first face yarn, the second face yarn, and the stitch-in yarn together, wherein a row of knots is formed;

a backing that is formed when a lay-in yarn is extended between at least two rows of the knots and knitted to hold the at least two rows of knots together;

a coating adhered to the backing to enhance longevity of the knot; and an underlay positioned beneath the backing such that a stable base is provided for the artificial turf.

16. The artificial turf of claim 15 wherein the first face yarn appears to be longer than the second face yarn.

17. The artificial turf of claim 15 wherein the second face yarn creates a textured zone at the base of the first face yarn.

18. The artificial turf of claim 15 further comprising a fill material disposed upon the backing, the fill material being placed onto the backing at a depth that corresponds to the second face yarn.

19. The artificial turf of claim 15 wherein the first face yarn extends at least one inch above the backing.

20. The artificial turf of claim 15 wherein the second face yarn creates a textured zone of approximately one half an inch.

21. The artificial turf of claim 15 wherein the lay-in yarn and the stitch-in yarn are each constructed of material from the group consisting of polyester and fiber glass.

22. The artificial turf of claim 15 wherein the second face yarn comprises a nylon material.

23. The artificial turf of claim 15 wherein the first face yarn comprises a nylon material.

24. An artificial turf comprising:

a first face yarn and a second face yarn;

a backing that is formed by knitting the first face yarn, the second face yarn, a stitch-in yarn, and a lay-in yarn such that the first face yarn appears to be longer than the second face yarn;

a coating coupled to the backing to prevent, among other things, detachment of the yarns after extended use of the artificial turf; and an underlayment positioned beneath the backing such that a stable base is provided for the artificial turf.

* * * * *